US006814185B1

(12) United States Patent
Ostrobrod

(10) Patent No.: US 6,814,185 B1
(45) Date of Patent: Nov. 9, 2004

(54) DESCENT CONTROLLER WITH SAFETY BRAKE

(76) Inventor: Meyer Ostrobrod, 2070 Bennett Rd., Philadelphia, PA (US) 19116

( * ) Notice: Subject to any disclaimer, the term of this patent is extended or adjusted under 35 U.S.C. 154(b) by 5 days.

(21) Appl. No.: 10/439,212

(22) Filed: May 15, 2003

(51) Int. Cl.[7] ..... A62B 1/20; B65H 59/16
(52) U.S. Cl. ..... 182/193; 182/191; 188/65.3
(58) Field of Search ..... 182/191–193, 182/231, 3–7, 234, 235; 188/65.1–65.5; 254/389–391

(56) References Cited

U.S. PATENT DOCUMENTS

| | | | | |
|---|---|---|---|---|
| 2,256,582 A | | 9/1941 | Sorensen | |
| 3,217,840 A | | 11/1965 | Holkesvick | |
| 3,738,449 A | | 6/1973 | Arancio | |
| 4,145,027 A | * | 3/1979 | Brimo | 182/193 |
| 4,399,889 A | * | 8/1983 | Todd | 182/6 |
| 4,476,956 A | * | 10/1984 | Eger | 182/5 |
| 4,550,801 A | | 11/1985 | Forrest | |
| 4,580,658 A | * | 4/1986 | Brda | 182/5 |
| 4,883,146 A | | 11/1989 | Varner et al. | |
| 5,038,888 A | | 8/1991 | Varner et al. | |
| 5,131,491 A | | 7/1992 | Varner et al. | |
| 5,145,036 A | | 9/1992 | Omalia | |
| 5,850,893 A | * | 12/1998 | Hede et al. | 182/193 |
| 6,131,697 A | | 10/2000 | Bassett | |

* cited by examiner

*Primary Examiner*—Hugh B. Thompson, II
(74) *Attorney, Agent, or Firm*—Norman E. Lehrer

(57) ABSTRACT

A descent controller for lowering a workman or other person along a vertically extending rope from an elevated position to a relatively lower position includes a friction device that may be in the form of a cylinder having a plurality of turns of rope wrapped therearound or a plurality of spaced apart horizontal bars with the rope woven between the bars. The friction device interacts with said rope to retard the movement of the controller along the rope. A lever operated pawl is mounted beneath the friction device and is used by the workman to applying an adjustable force on said rope in order to control his descent down the rope. A centrifugal brake is mounted below the lever centrifugal brake. The centrifugal brake includes a wheel mounted for rotation and has the rope passing around at least a portion of said wheel. Included within the brake is a pawl brake mounted for rotation with the wheel and a fixed stop member. Upon sensing rapid rotation of the wheel, the pawl brake moves outwardly by centrifugal force to engage the fixed stop member and applies a positive stopping force on the wheel to prevent movement of the descent controller relative to said rope thereby preventing accidental freefall.

23 Claims, 4 Drawing Sheets

DESCENT CONTROLLER WITH SAFETY BRAKE

BACKGROUND OF THE INVENTION

The present invention is directed toward a safety apparatus and more particularly toward a safety apparatus in the form of a descent controller used by a workman or other person to control his descent down a rope. The descent controller of the present invention also includes a centrifugal brake-that prevents the rapid descent of the workman.

Descent control devices have been developed; all with the objective of lowering a person or load from a higher to a lower elevation. These devices have taken many forms and have utilized a variety of elements capable of providing a mechanical advantage together with a braking mechanism. Safety features, such as deadman and panic control features, are equally important, particularly when the device is used for descent, escape, or rescue purposes.

In more recent years, concerns with occupational safety have led to the development of mechanisms which enable a worker to lower himself from an elevated position such as a scaffold, crane, lift truck or platform in the event of an emergency. The equipment is, in many respects, similar to known fire escape devices, mountain climbing equipment, and military equipment.

A descent load lowering device in the form of a small cylindrical drum about which a rope is wound to provide a descent braking function is disclosed in U.S. Pat. No. 4,550,801 to Forrest. The device shown therein includes end plates on each end of a cylindrical drum with apertures on each end plate through which a rope is threaded and wound in two of more turns around the drum. The lower end plate is provided with one or more arcuate tapered slots opening into the rope receiving aperture for engaging and binding the rope in order to increase friction and form somewhat of a brake. The operator grasps and moves the free untensioned end of the rope along a tapered slot to vary the rate of descent or stop it altogether by tensioning and holding the rope in the narrow end of the arcuate tapered slot.

While devices such as shown in the Forest patent have provided some benefit, they take some skill and experience to operate properly. Furthermore, should the workman make a mistake or be injured, there are no safety provisions for automatically controlling his descent or for preventing freefall.

A descent control device with a brake, in the form of a vertical cylindrical drum or capstan about which a rope is wound and a tapered slot through the drum for receiving and releasably gripping the rope along which descent is made, together with a releasable locking end plate, is described in U.S. Pat. No. 4,883,146 to Varner et al. As with Forrest, the device shown in the Varner et al. patent includes end plates on each end of a vertical cylindrical drum or capstan with apertures on each end plate through which a rope is threaded. The rope is wound in two or more turns around the drum. The lower plate is provided with an arcuate tapered slot opening into the rope receiving aperture for engaging and binding the rope in order to provide a brake.

Unlike Forrest, however, the rope of Varner et al. is mechanically forced into the aperture by a locking end plate rotatably mounted on the capstan below the lower end plate. The locking plate includes an aperture for loosely receiving the rope. A spring rotatably biases the locking plate to releasably and forcibly urge the rope into the narrowed tapered slot in the lower end plate for locking the rope against movement on the capstan. By rotating the locking plate against the force of the spring the rope can be progressively released from the tapered slot.

Apparently recognizing the difficulty in operating the device of the Varner et al. '146 patent, the inventors designed improvements thereon and obtained U.S. Pat. Nos. 5,038,888 and 5,131,491. These improvement patents, however, continue to rely on the original concept of forcing a rope into an arcuate slot to control decent. These improved patented devices can still be difficult to operate because of the manner in which they must be manipulated to control ones descent.

In addition, and perhaps more importantly, none of the Forrest or Varner et al. devices includes a mechanism such as an additional safety brake or the like. Such a brake could prevent serious injury to a workman in the event of an unwanted rapid descent or freefall due to a malfunction of the descent controller or due to the workman improperly using the device from panic or as a result of an injury. While positive safety brakes are known, none has ever been combined with a descent controller.

SUMMARY OF THE INVENTION

The present invention is designed to overcome the deficiencies of the prior art discussed above. Accordingly, it is an object of the invention to provide a descent controller that is easy to operate and unlikely to malfunction.

It is a further object of the present invention to provide a descent controller that provides a smooth controlled descent with limited skill or training needed by the operator.

It is a still further object of the invention to provide a descent controller that includes a safety brake that will automatically stop descent or freefall due to a malfunction of the descent controller or due to the workman improperly using the device from panic or as a result of an injury.

In accordance with the illustrative embodiments demonstrating features and advantages of the present invention, there is provided a descent controller for lowering a workman or other person along a vertically extending rope from an elevated position to a relatively lower position includes a friction device that may be in the form of a cylinder having a plurality of turns of rope wrapped therearound or a plurality of spaced apart horizontal bars with the rope woven between the bars. The friction device interacts with said rope to retard the movement of the controller along the rope. A lever operated pawl is mounted beneath the friction device and is used by the workman to applying an adjustable force on said rope in order to control his descent down the rope. A centrifugal brake is mounted below the lever centrifugal brake. The centrifugal brake includes a wheel mounted for rotation and has the rope passing around at least a portion of said wheel. Included within the brake is a pawl brake mounted for rotation with the wheel and a fixed stop member. Upon sensing rapid rotation of the wheel, the pawl brake moves outwardly by centrifugal force to engage the fixed stop member and applies a positive stopping force on the wheel to prevent movement of the descent controller relative to said rope thereby preventing accidental freefall.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENT

Figure 1:
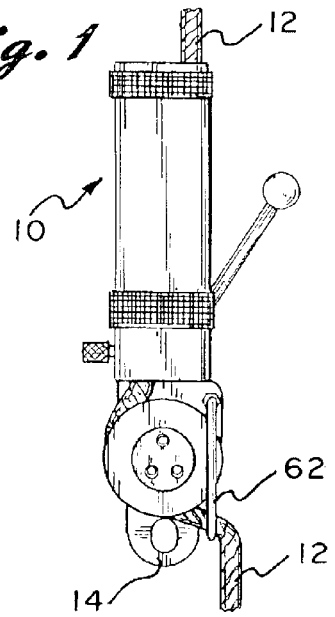
FIG. 1 is a front elevational view showing the overall arrangement of the descent controller of the present invention attached to a vertically extending rope.
Figure 2:
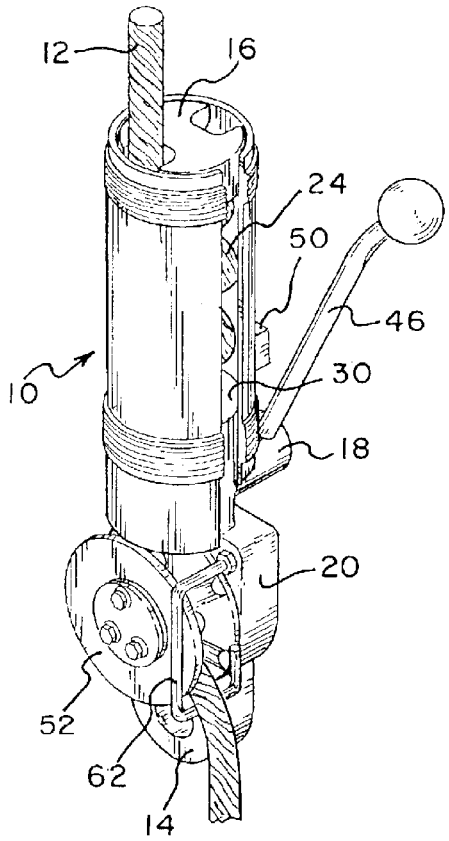
FIG. 2 is an enlarged perspective view of the descent controller of FIG. 1 showing some of the details thereof.

Referring now to the drawings in detail wherein like reference numerals have been used throughout the various figures to designate like elements, there is shown in FIGS. 1 and 2 a descent controller with a safety brake designated generally as 10. The descent controller 10 is shown attached to a rope 12 that has its upper end connected to the top of a building or other elevated structure and which hangs straight downwardly. As is conventional in the art, a workman wearing a harness will connect himself through the use of a carabiner or the like to the eyebolt 14 located at the bottom of the descent controller 10.

All of the foregoing general description of the descent controller 10 and the manner in which it is used are well known in the art. While the present invention is an improvement on prior devices of the same class, the general use and purpose of the invention is well known. It is generally used by a workman or other person to lower himself from an elevated position to a relatively lower position in a safe and controlled manner.

Figure 3:
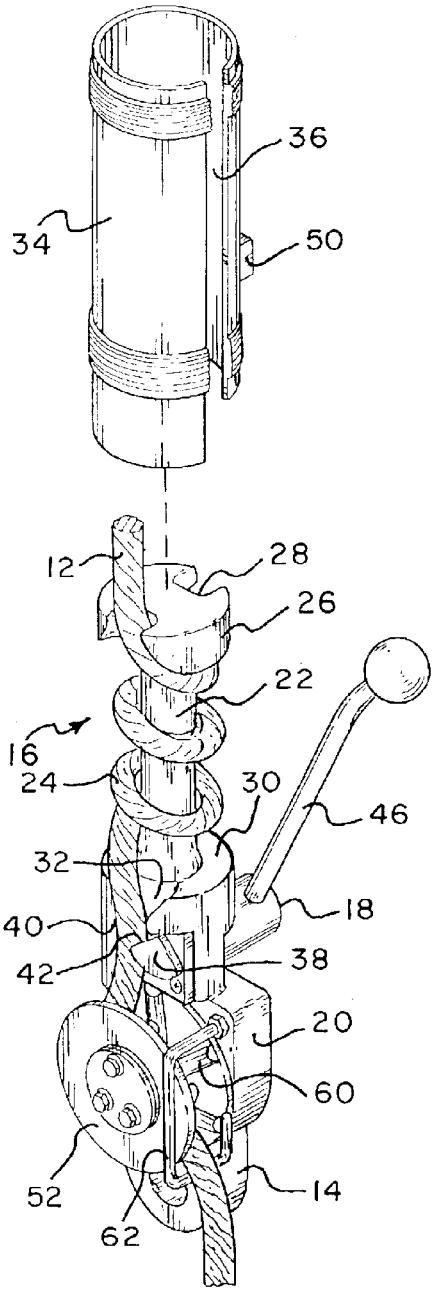
FIG. 3 is a view similar to FIG. 2 but with the cover removed to expose the details of the interior thereof.

The descent controller 10 is comprised essentially of three parts. An upper friction means 16, a force applying means 18 and a safety brake 20. The friction means 16 is comprised essentially of a cylinder 22 having a length which is adapted to receive a plurality of turns 24 of rope 12 wrapped therearound as shown in FIG. 3. An upper flange 26 having a pair of notches 28 formed therein is secured to the top of the cylinder 22 and the rope 12 passes through one of the notches 28 prior to being wrapped around the cylinder 22. A similar flange 30 having a notch or opening 32 is mounted to the bottom of the cylinder 22 and allows the rope to pass downwardly therethrough.

With the rope 12 passing through the notch 28, being wound around the cylinder 22 and passing downwardly through the notch 32, a substantially cylindrical cover 34 can be applied over the friction means 16. Because the rope 12 will be suspended from above and will be of significant length, the cover 34 is provided with an elongated slot 36 in the outer wall thereof so that it can pass around the rope 12. Appropriate locking means can be provided for locking the cover 34 onto the main body portion of the descent controller so that it is securely held in the position as shown, for example, in FIGS. 1 and 2.

The friction means 16 just described is, per se, conventional and well known in the art. A basic example of the same can be found in the Forrest patent described above and more sophisticated examples are shown in the Varner et al. patents.

The adjustable force applying means 18 located beneath the friction means 16 is adapted to selectively apply an adjustable force on the rope in order for a workman to control his descent. This aspect of the invention includes a movable pawl 38 and a fixed wall segment 40. Preferably, the inner surface of the wall 40 is curved so as to follow the outer contours of the rope 12 resting against the wall 40 as shown in FIG. 3. The face 42 of the pawl 38 is preferably substantially parallel to the fixed wall segment 40 so that it can apply an even force against a short length of the rope.

Figure 6:
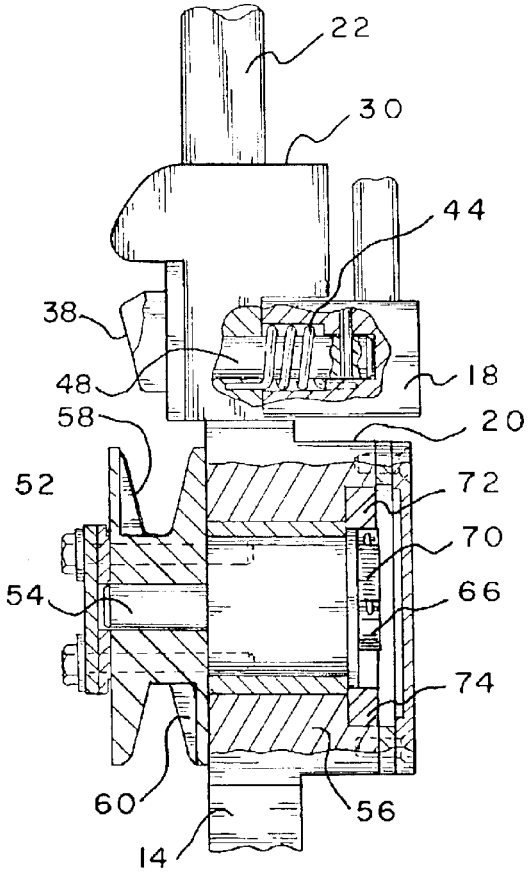
FIG. 6 is a partial cross-sectional view taken through the lines 6—6 of FIG. 5 but with the rope removed for clarity.
Figure 5:
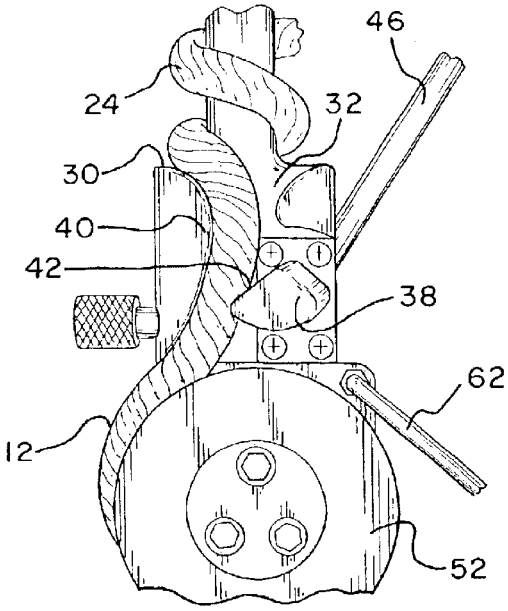
FIG. 5 is an enlarged elevational of the lower portion of FIG. 2 illustration the operation of the lever and force applying pawl.

The pawl 38 is normally spring biased toward the wall segment 40 through the use of a coil spring 44 (see FIG. 6) so that a constant force is normally applied against the rope to impede the movement of the descent controller downwardly. When a workman desires to descend, he rotates the pawl 38 away from the rope 12 by rotating the lever 46 which, through shaft 48, controls the movement of the pawl.

In order to prevent too rapid of a descent, a stop mechanism such as shown at 50 in FIG. 3 may be mounted on the cover 34. The stop 50 prevents the lever from moving the pawl 38 to a position where it is totally disengaged from the rope 12. As should be readily apparent to those skilled in the art, the stop 50 is preferably provided on the cover 34 rather than providing some other type of stop or motion limit within the body of the device that would prevent full opening movement of the pawl 38. This is necessary since, when assembling the descent controller on a suspended rope, the pawl 38 must be moved sufficiently away from the wall 40 to allow the rope 12 to be introduced therein. Thus, when initially securing the device to a rope, the pawl 38 must be moved entirely away from the wall 40.

When properly operated, a workman can control the use of the descent controller and his resultant descent by moving the lever 46. There is always the remote possibility, however, that the pawl or lever may malfunction, that the rope could disengage from its proper location between the pawl 38 and the stationary wall segment 40 or that the workman could panic and hold the lever in the open position. This would result in the rapid descent of the workman which could create a dangerous situation. Accordingly, the present invention is provided with the safety brake 20.

The brake 20 is in the form of a centrifugal brake and is comprised of a wheel 52 secured to axle 54 for rotation therewith relative to the housing 56. As shown most clearly in FIGS. 2, 3 and 4, the rope 12 is adapted to pass around at least a portion of the wheel 52 within the groove 58 thereof. The walls of the groove 58 are preferably formed with a plurality of ribs 60 to ensure that the wheel tightly, grips the rope passing therearound.

Figure 4:
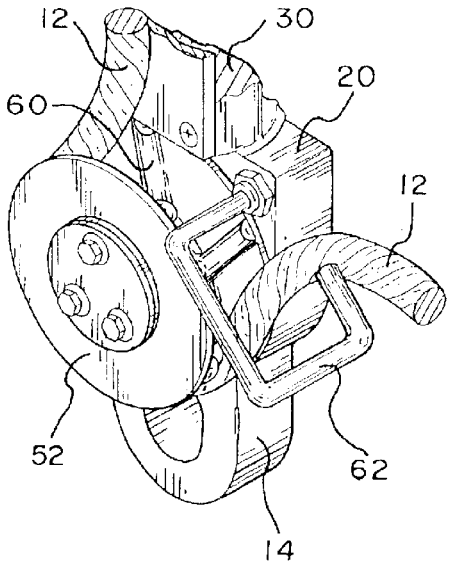
FIG. 4 is an enlarged perspective view of the lower portion of FIG. 2 illustrating how the rope is applied to the centrifugal brake.

A rotatable wire bale 62 ensures that the rope 12 is forced around the wheel 52. As shown in FIGS. 1, 2 and 3, the weight of the lower most portion of the rope 12 pulls the bale 62 downwardly so that the rope is forced into engagement with the wheel. As shown in FIG. 4, however, the bale can be pivoted upwardly and includes an open side so that the rope can be assembled onto the bale when the descent controller 10 is being applied to a suspended rope 12.

Figure 7:
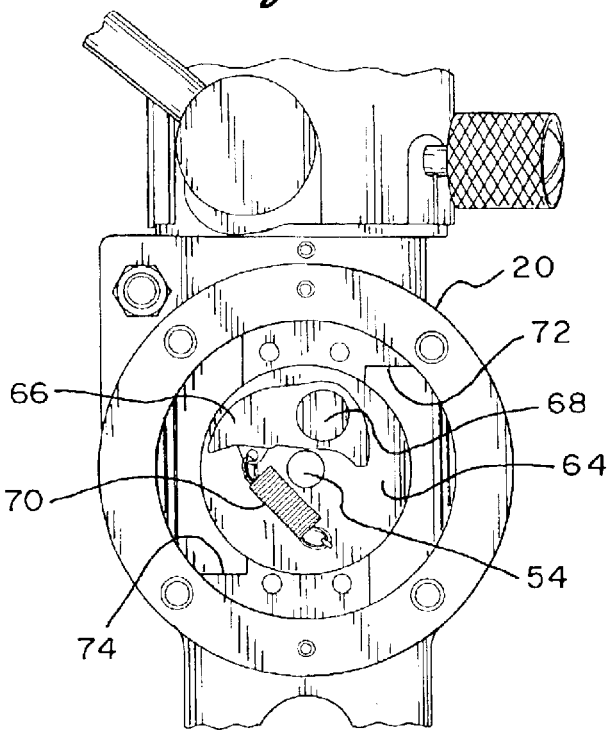
FIG. 7 is a detailed elevational view of the centrifugal brake shown in its inoperative position.
Figure 8:
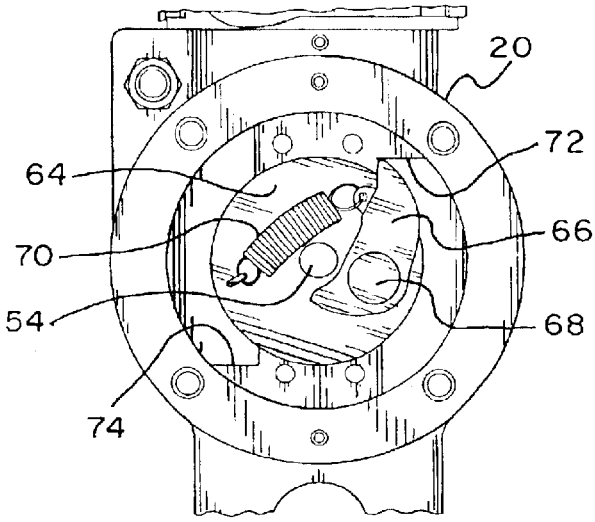
FIG. 8 is a detailed elevational view of the centrifugal brake shown in its operative position.

As shown most clearly in FIGS. 7 and 8, the centrifugal brake includes a plate 64 fixed to the shaft 54 so that the plate 64 rotates with the wheel 52. A braking pawl 66 is eccentrically mounted onto the plate 64 so as to be rotatable about the axis 68. The braking pawl 66 is normally biased inwardly through the use of spring 70. Thus, during normal rotation of the wheel 52 and hence the plate 64, the brake pawl 66 will remain essentially in the position shown in FIG. 7. During normal descent of the descent controller 10, the plate 64 will rotate counterclockwise as viewed in FIG. 7.

Located outside of the circumference of the plate 64 and secured to the main body portion of the descent controller are a pair of fixed stops 72 and 74 which are preferably spaced 180° away from each other. As long as plate 64 is rotating at a reasonable speed, the pawl 66 remains in the position shown in FIG. 7 due to the force of the spring 70. However, in the event of rapid rotation of the plate 64 caused by rapid rotation of the wheel 52, the pawl is pulled outwardly by centrifugal force against the spring 70 and will engage the stop 72 or 74 to thereby prevent any further rotation of the wheel 52. This will occur within a fraction of a second and will, therefore, prevent any further downward movement of the descent controller 10.

Figure 9:
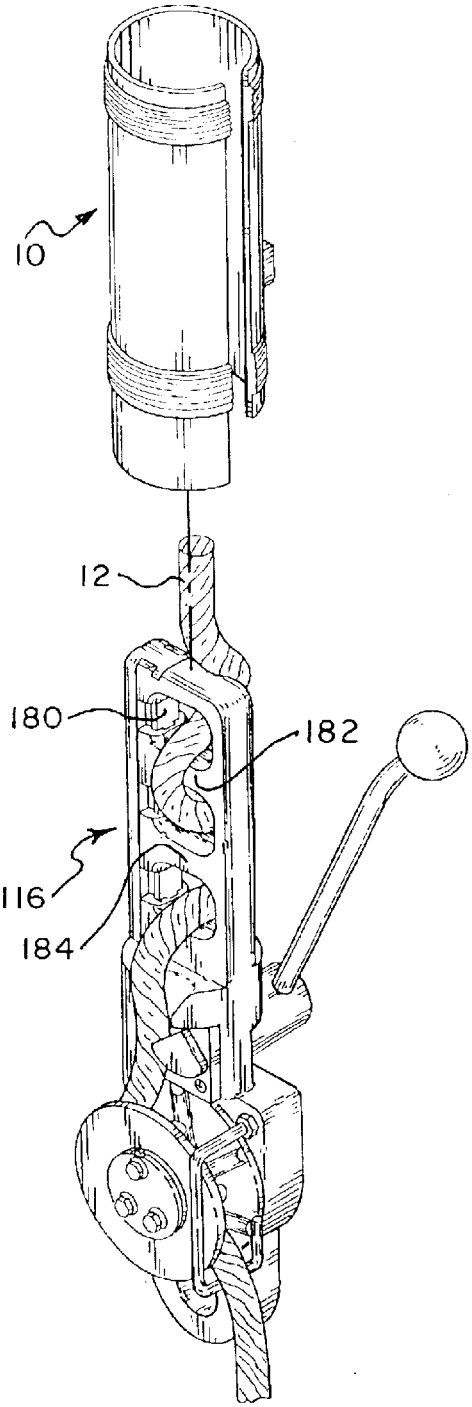
FIG. 9 is a perspective view similar to FIG. 3 but showing a second embodiment of the descent controller of the present invention.
Figure 10:
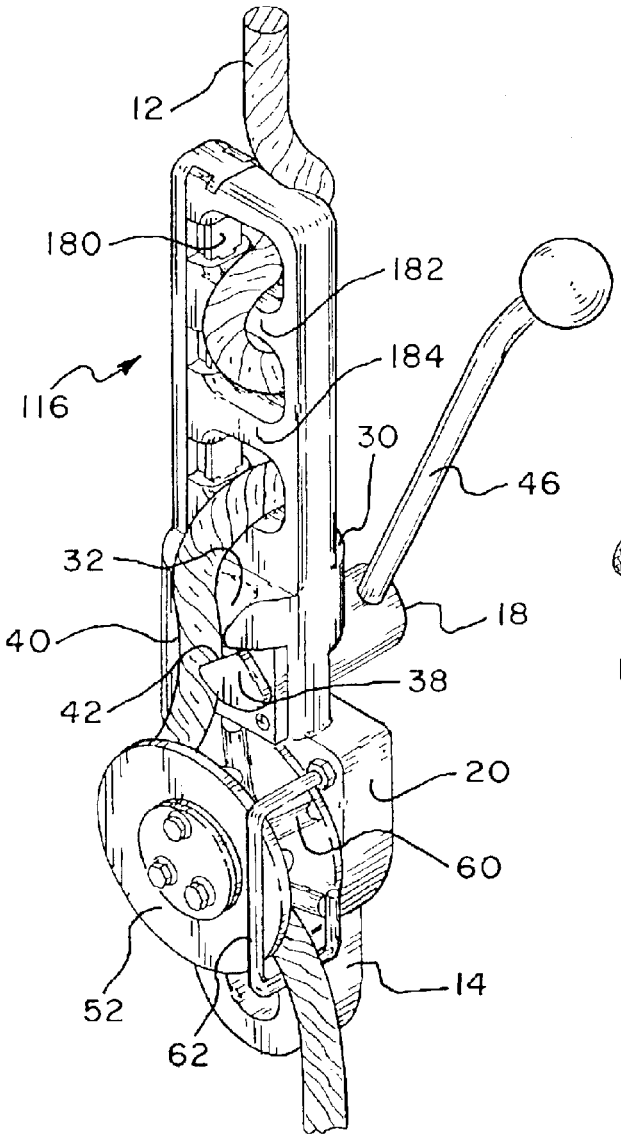
FIG. 10 is and enlarged view of the lower portion of FIG. 9.
Figure 11:
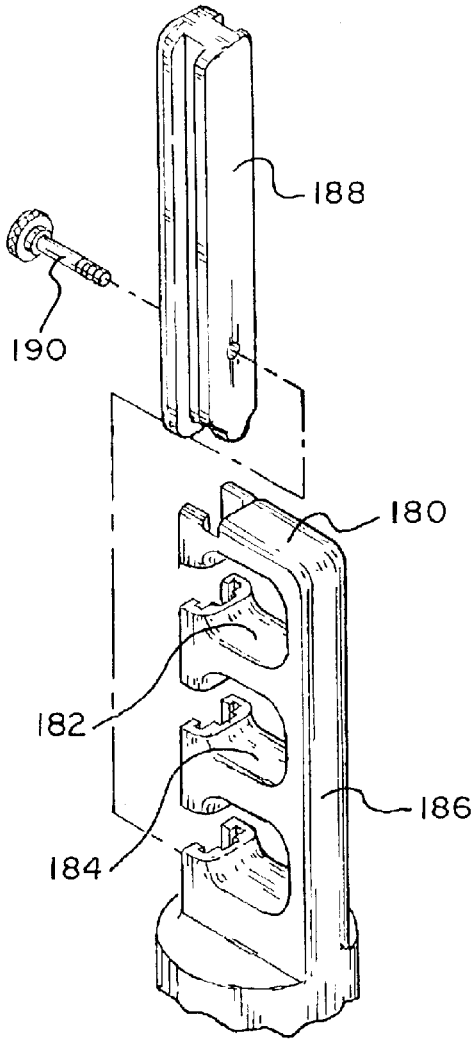
FIG. 11 is an exploded view of the friction means of the second embodiment shown at the top of FIG. 10.

A second embodiment of the invention is illustrated in FIGS. 9, 10 and 11. More particularly, the force applying means and safety brake shown in this embodiment are identical to the force applying means and safety brake of the first embodiment. Only the friction means for interacting with the rope and retarding the movement thereof differs. Accordingly, the following description will be limited to the friction means.

The friction means 116 of this embodiment includes a plurality of vertically spaced apart horizontal bars 180, 182 and 184 supported between vertical side posts 186 and 188. As shown best in FIGS. 9 and 10, the rope 12 is essentially woven between the bars 180, 182 and 184 so as to create a resistive force to retard the movement of the rope. Devices of this class are generally known and are shown, for example, in FIGS. 44–47 of Varner et al. U.S. Pat. No. 5,131,491.

As best seen in FIG. 11, vertical side post 188 is removable. This may be accomplished, for example, by including a tongue and groove or slot arrangement so that the side post 188 can be moved upwardly or slide downwardly and locked in position utilizing a threaded thumb screw 190. The removability of the side post 188 allows for the rope 12 to be woven into its proper configuration without having to pass the end of the rope through and around each of the horizontal bars 180, 182 and 184. With the descent controller of FIGS. 9–11 in place, it is operated in essentially the same manner as the first embodiment described above.

The present invention may be embodied in other specific forms without departing from the spirit or essential attributes thereof and accordingly, reference should be made to the appended claims rather than to the foregoing specification as indicating the scope of the invention.

I claim:

1. A descent controller for lowering a rope supported load from an elevated position to a relatively lower position, said controller including a friction means interacting with said rope for retarding the movement of said controller along said rope, said friction means having an upper end and a lower end, means mounted adjacent the lower end of said friction means for applying an adjustable force on said rope, and a centrifugal brake means mounted below said force applying means for positively stopping the movement of said descent controller relative to said rope.

2. The descent controller as defined in claim 1 wherein said friction means is comprised of a cylinder of a length adapted to receive a plurality of turns of rope wrapped therearound.

3. The descent controller as defined in claim 2 further wherein said means for applying an adjustable force includes a fixed wall segment and a movable pawl and wherein said rope is adapted to pass between said pawl and said wall segment.

4. A descent controller as defined in claim 3 therein said pawl is spring biased toward said wall.

5. A descent controller as defined in claim 4 further including a manually operative lever secured to said pawl, said lever being adapted to move said pawl away from said wall and rope to reduce the force on said rope.

6. A descent controller as defined in claim 3 wherein said wall is curved so as to follow the contours of a portion of the rope.

7. A descent controller as defined in claim 3 wherein said pawl includes a face that is adapted to engage said rope to force the same against said fixed wall segment.

8. A descent controller as defined in claim 7 wherein said face of said pawl is substantially parallel to said fixed wall segment.

9. A descent controller as defined in claim 2 wherein said centrifugal brake means includes a wheel mounted for rotation below said cylinder, said rope passing around at least a portion of said wheel.

10. A descent controller as defined in claim 9 wherein said wheel includes means for gripping said rope passing therearound.

11. A descent controller as defined in claim 10 wherein said centrifugal brake means includes a pawl brake mounted for rotation with said wheel and a fixed stop, said pawl brake being spring biased away from said fixed stop.

12. A descent controller as defined in claim 11 wherein said pawl brake moves outwardly by centrifugal force to engage said fixed stop upon rapid rotation of said wheel.

13. A descent controller as defined in claim 1 wherein said friction means is comprised of a plurality of spaced apart horizontal bars and wherein said rope is adapted to be woven between said bars.

14. A descent controller as defined in claim 13 further wherein said means for applying an adjustable force includes a fixed wall segment and a movable pawl and wherein said rope is adapted to pass between said pawl and said wall segment.

15. A descent controller as defined in claim 14 wherein said pawl is spring biased toward said wall.

16. A descent controller as defined in claim 15 further including a manually operative lever secured to said pawl, said lever being adapted to move said pawl away from said wall and rope to reduce the force on said rope.

17. A descent controller as defined in claim 14 wherein said wall is curved so as to follow the contours of a portion of the rope.

18. A descent controller as defined in claim 14 wherein said pawl includes a face that is adapted to engage said rope to force the same against said fixed wall segment.

19. A descent controller as defined in claim 18 wherein said face of said pawl is substantially parallel to said fixed wall segment.

20. A descent controller as defined in claim 13 wherein said centrifugal brake means includes a wheel mounted for rotation below said friction means, said rope passing around at least a portion of said wheel.

21. A descent controller as defined in claim 20 wherein said wheel includes means for gripping said rope passing therearound.

22. A descent controller as defined in claim 21 wherein said centrifugal brake means includes a pawl brake mounted for rotation with said wheel and a fixed stop, said pawl brake being spring biased away from said fixed stop.

23. The descent controller as defined in claim 22 wherein said pawl brake moves outwardly by centrifugal force to engage said fixed stop means upon rapid rotation of said wheel.

* * * * *

UNITED STATES PATENT AND TRADEMARK OFFICE

CERTIFICATE OF CORRECTION

PATENT NO. : 6,814,185 B1
APPLICATION NO. : 10/439212
DATED : November 9, 2004
INVENTOR(S) : Meyer Ostrobrod It is certified that error appears in the above-identified patent and that said Letters Patent is hereby corrected as shown below:

Col. 6,
Claim 9, line 3, “passing” should read --adapted to pass--

Col. 7,
Claim 20, line 3, “passing” should read --adapted to pass--

Col. 8,
Claim 23, line 3, “means” should be deleted

Col. 6 & 7,
Claims 4-22, line 1 of each, “A” should be --The--

Signed and Sealed this

Thirteenth Day of November, 2007

JON W. DUDAS
*Director of the United States Patent and Trademark Office*